US005913769A

United States Patent [19]

Byma et al.

[11] Patent Number: 5,913,769

[45] Date of Patent: Jun. 22, 1999

[54] COMBINATION DESK AND BED

[75] Inventors: Ralph Byma, Zeeland; Gregg J. Persons, Wyoming, both of Mich.

[73] Assignee: Sligh Furniture Company, Holland, Mich.

[21] Appl. No.: 08/577,221

[22] Filed: Dec. 22, 1995

[51] Int. Cl.[6] ..... A47B 23/00

[52] U.S. Cl. ..... 5/2.1; 5/3; 5/6

[58] Field of Search ..... 5/2.1, 6, 3

[56] References Cited

U.S. PATENT DOCUMENTS

| | | | |
|---|---|---|---|
| 117,632 | 8/1871 | Hopf . | |
| 224,679 | 2/1880 | Green . | |
| 445,777 | 2/1891 | Goodwillie . | |
| 611,063 | 9/1898 | Davis | 5/2.1 |
| 716,026 | 12/1902 | Geisel . | |
| 905,448 | 12/1908 | Messel . | |
| 2,544,762 | 3/1951 | Lochridge | 5/2.1 |
| 2,672,624 | 3/1954 | Giuseffi | 5/2.1 |
| 2,754,524 | 7/1956 | Densmore | 5/2.1 |
| 2,770,813 | 11/1956 | Marzillier | 5/2.1 |
| 3,858,253 | 1/1975 | Lauzon . | |
| 3,965,498 | 6/1976 | Boni | 5/6 |
| 4,016,610 | 4/1977 | Ordonez . | |
| 4,070,715 | 1/1978 | Reppas | 5/2.1 |
| 4,318,195 | 3/1982 | Reppas . | |
| 4,619,005 | 10/1986 | Rutens . | |
| 5,400,447 | 3/1995 | Pokorny | 5/2.1 |

FOREIGN PATENT DOCUMENTS

| | | | |
|---|---|---|---|
| 21576 | 1/1892 | United Kingdom | 5/2.1 |

*Primary Examiner*—Rodney M. Lindsey
*Assistant Examiner*—Fredrick Conley
*Attorney, Agent, or Firm*—Water & Morse P.C.

[57] ABSTRACT

A combination desk and fold-out bed comprises a desk top supported on side panels; a pair of movable pedestals that fit in a front area of a desk opening under the desk top and adjacent inner sides of the side panels, the pedestals being removable from the desk opening to serve as night stands; and a fold-up bed mounted in a back area of the desk opening, behind the position of the pedestals when they are positioned in the front area of the desk opening, the bed being movable forwardly through the open front of the desk and unfoldable forwardly to an open position when the pedestals are removed. A pair of movable door panels extend between the pedestals and conceal the folded bed at the rear portion of the desk opening, when the pedestals are in place under the desk top, in the desk opening. The door panels are hinged to the pedestals and pivot forwardly to lay against the sides of the pedestals and provide access to the bed.

20 Claims, 4 Drawing Sheets

COMBINATION DESK AND BED

BACKGROUND OF THE INVENTION

Field of the Invention

The present invention relates to a combination desk and bed, wherein a folded bed is stored in a back area of a desk, under a desk top. More particularly, the folded bed is accessed through a moveable panel, by unfolding the bed forwardly through a front area of the desk.

At the present time, there is an increasing trend toward incorporating an office in the home. This is done for a variety of purposes, including household financial matters, and doing business work at home. The use of home computers also provides an increasingly popular function for home office furniture. Home offices typically include a desk and file or drawer storage.

With a premium on space in most homes and apartments, however, it is sometimes necessary to consider conversion of a traditional guest bedroom into a home office, typically losing or at least severely compromises the guest bedroom. One will, therefore, appreciate an increasing need to inconspicuously incorporate a fold-out bed into a fully functional desk so that a home office can be used as a guest bedroom when necessary and, further, so that a desk used in an office can provide a bed on the occasion that it is necessary to stay all night in the office.

SUMMARY OF THE INVENTION

The present invention addresses the contemporary pressures to maximize space utilization with a combination desk and fold-out bed. In accordance with the invention, a combination desk and fold-out bed comprises a desk top supported on side panels at sides of the desk, defining a desk opening under the desk top, the desk having an open front at a front side of the desk opening between the side panels. A pair of movable pedestals fit in a front portion of the desk opening adjacent an inner side of each side panel, the pedestals being removable from the desk opening to a position to the side of the desk, where they can serve as night stands. A fold-up bed is mounted in a rear portion of the desk opening behind the pedestals when they are positioned in the desk opening. In a stored position, the bed extends laterally behind the pedestals. The bed is movable forwardly through the open front of the desk and unfolds forwardly to an open position after the pedestals are removed. The desk includes movable door panels that separate the front and rear portion of the desk opening between the pedestals, concealing the folded bed in the rear portion. The panels are hinged to the pedestals and lie flat against the sides of the pedestals when the panels are opened, providing access to the bed.

These and other features, advantages, and benefits of the invention are apparent and will be understood by one skilled in the art, from the specification, including the drawings, and the claims.

DESCRIPTION OF THE PREFERRED EMBODIMENT

Figure 3:
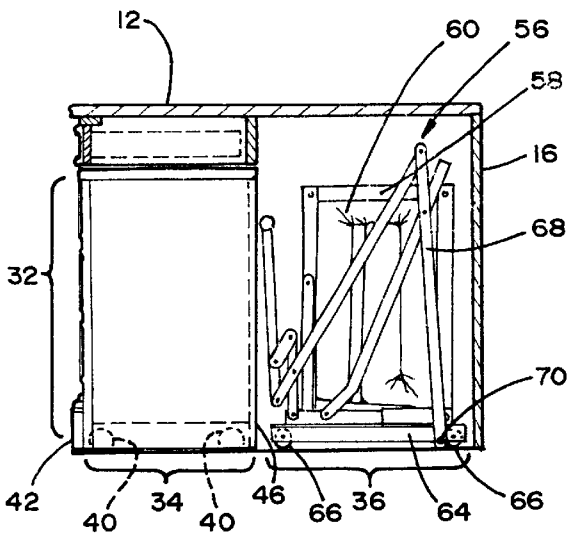
FIG. 3 is a cross-sectional view taken along lines 3—3 of FIG. 1.
Figure 2:
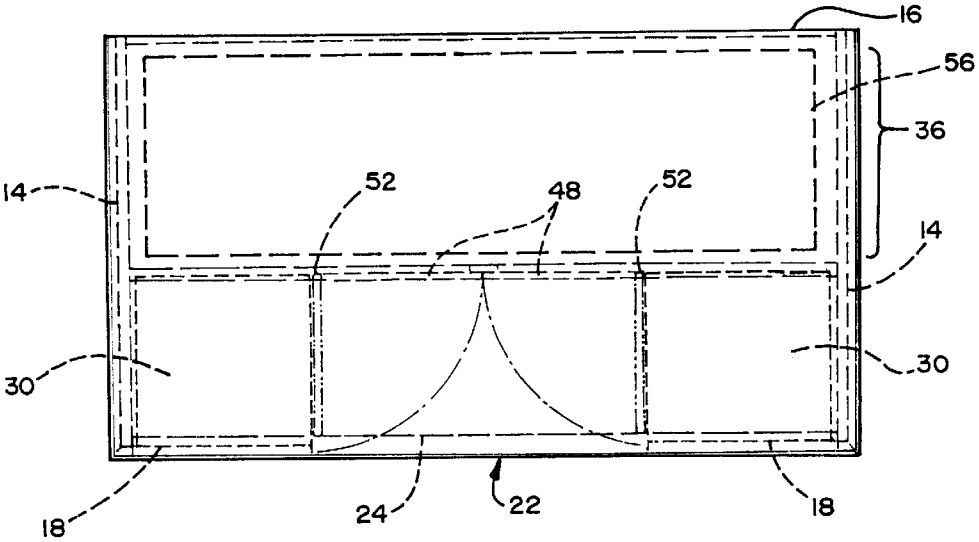
FIG. 2 is a plan view of the desk of FIG. 1.
Figure 1:
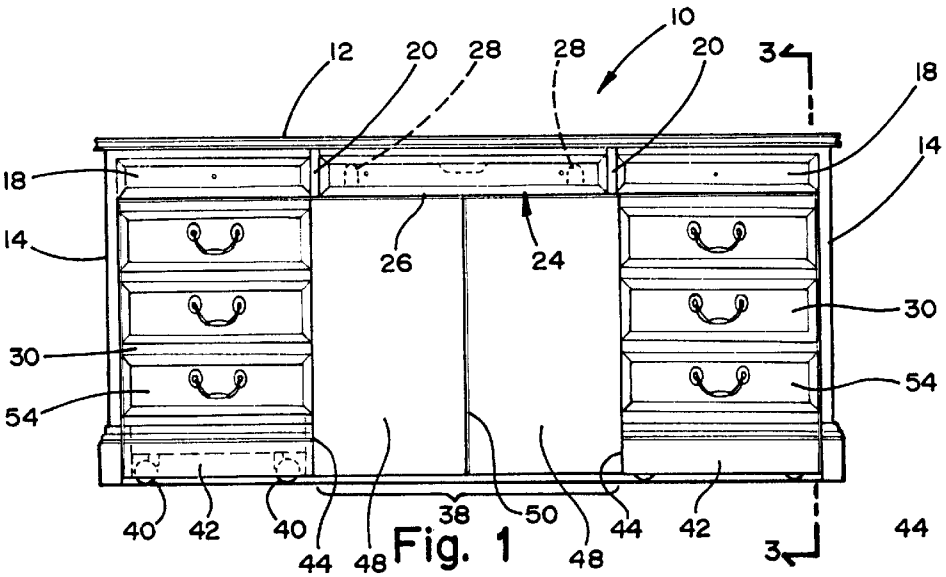
FIG. 1 is a front elevational view of a desk incorporating a folding bed in accordance with the present invention, with the bed folded into a stored position.

Referring now to the drawings, FIGS. 1–3 show a desk bed unit 10 in accordance with the present invention, with the bed 56 being folded away for storage and the unit 10 being configured for use in the form of a desk.

Desk bed 10 comprises a conventional desk top 12 supported by vertical side panels 14 that are located near opposing sides of the desk top, and a back panel 16 that encloses a back of the desk. The desk is constructed from wood components in the exemplary embodiment, but other materials could be used. The desk can have a conventional desk size, the exemplary desk being about 72 inches wide, about 37¼ inches deep, and about 30 inches high. A conventional depth might be as great as 48 inches. Larger and smaller sizes can also be used. The desk includes two drawer units 18 mounted on the underside of desk top 12 between outer panels 14 and a pair of inner panels 20 that extend downwardly from the desk top 12, a distance sufficient to support the sides of the drawer units 18. A center drawer unit 22 may be configured as a concealed slide out computer tray 24, covered by a front panel 26 that folds down to reveal the keyboard tray. The front panel 26 is shown in phantom in the folded down position in FIG. 3. When the front panel 26 is folded up, it has the same general appearance as the facing panels for drawers 18 that are visible in FIG. 1. The back of the keyboard drawer may be provided with wire openings 28 and wire guides to avoid entangling wires in the bed 56. A computer may be placed on the desk top. A hutch 90 (FIG. 6) or other storage unit may also be placed on top of the desk.

The area underneath the desk top 12, excluding drawer units 18 and 24, is referred to as the desk opening and is generally designated by numeral 32 in FIG. 3. The desk opening 32 is divided into a front area or compartment 34 and a rear area or compartment 36. In a central portion of the front compartment 34 is a kneehole opening 38 that accommodates the knees of a person seated at the desk. The depth of the front area 34 of the desk opening 32 should be sufficiently deep to provide adequate knee room for a typical desk user. A depth of about 16¼ inches is satisfactory. The depth of the rear area 36 of the desk opening 32, which functions as a bed storage compartment, should be sufficiently deep to accommodate a folding bed. With the folding bed of the present invention, a depth of about 19 inches is satisfactory.

A pair of pedestals 30 are positioned in the front portion 34 of the desk opening 32 adjacent the inner sides of side panels 14. These pedestals define the sides of kneehole opening 38. Pedestals 30 fit closely under the bottom of drawer units 18 and are of a compatible decor, such that the pedestals 30 give the appearance of pedestals permanently mounted in the desk opening. The pedestals 30 are, however, mounted on wheels or casters 40 and can be rolled out of their positions under the desk top 12, in desk opening 32. The pedestals 30 have front molding panels 42 and side panels 44 and a rear panel 46 that extend downwardly over the casters adjacent to floor level to form a skirt that conceals the casters under the pedestals 30 and make it appear as if the pedestals 30 are fixed position, non-movable, integral desk pedestals.

Door panels 48 are mounted on the inner rear corners of the separate pedestals 30, with each door panel 48 extending transversely across the desk opening 32 and abutting at a junction 50 at the middle of the kneehole opening 38. Door panels 48 are pivotally mounted to the inside rear corner edges of pedestals 30 by hinges 52. The hinges 52 permit the doors 48 to be opened in a forward direction, toward the open front of the desk 10, so the doors 48 lay flat against the inner, side panels 44 of the pedestals 30. When doors 48 are closed (the position shown in FIG. 1), the doors 48 extend across the entire rear side of the kneehole opening 38 and give the impression of being the back panel or a modesty panel in the desk. The doors 48 may be held in the closed position by magnetic catches that cooperate with the metal carriage 64 (discussed further below) of the bed 56. The pedestals 30 also are provided with slide out drawers 54 that may be conventional drawers or may be file drawers and the like. To stabilize each pedestal 30 when the bottom drawer is opened, a fifth wheel or caster 40 may be mounted under the front of the bottom drawer and the front panel 42 may be connected with the bottom drawer, so the fifth wheel and the front panel move with the bottom drawer and the fifth wheel or caster supports the front of the bottom drawer to resist tipping and falling of the pedestal 30.

A folding bed 56 is stored inconspicuously in the back area 36 or bed compartment of the desk opening. When the desk is closed (FIG. 1), the bed 56 is completely concealed in the bed compartment 36 and there is no way to distinguish the desk from an ordinary desk.

Figure 4:
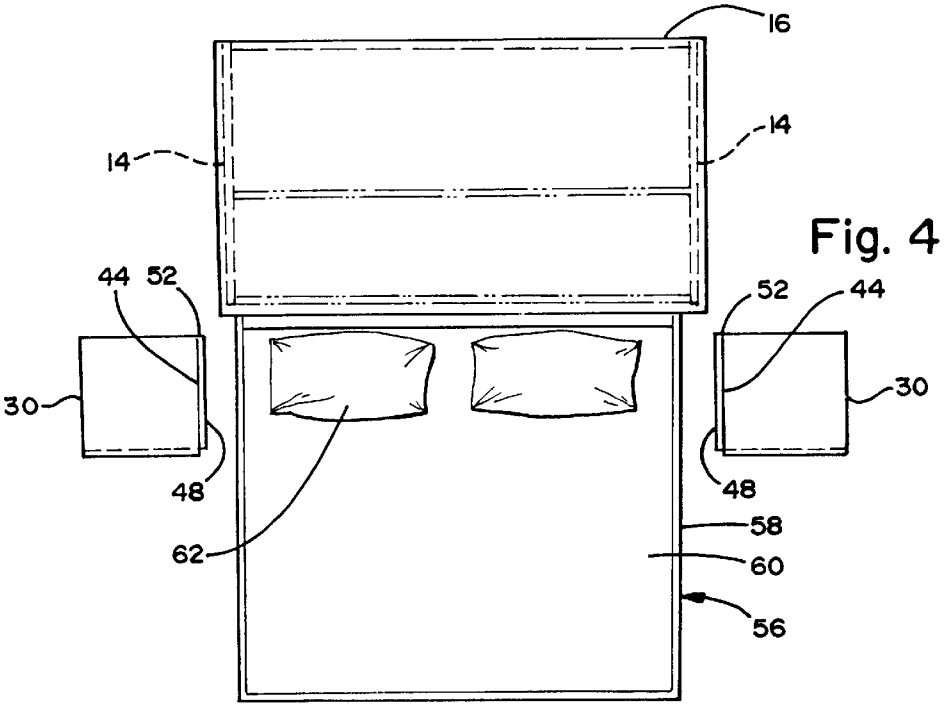
FIG. 4 is the view of FIG. 2 with the bed extended into an open position.
Figure 5:
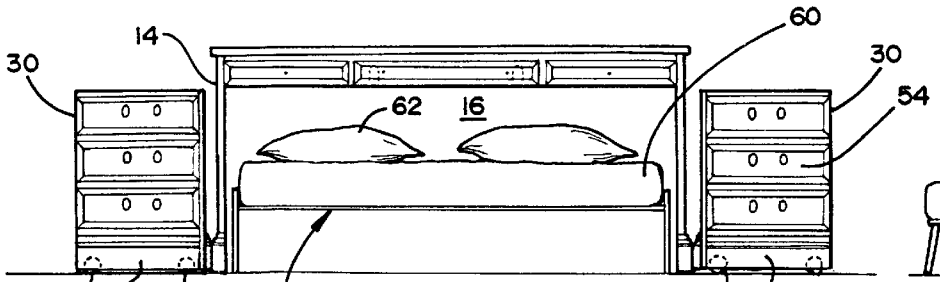
FIG. 5 is a front elevational view of the bed unit of FIG. 4.
Figure 6:
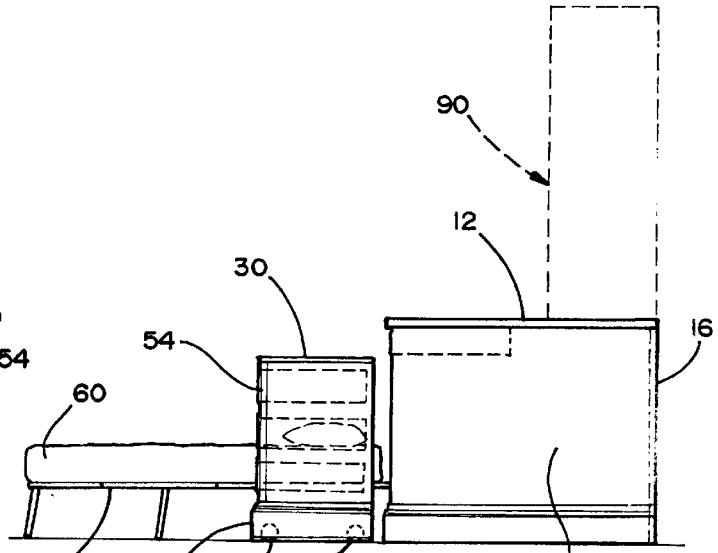
FIG. 6 is a side elevational view of the bed unit of FIG. 4.

When it is desired to use the desk as a bed, however, the desk may be converted into the bed configuration shown in FIGS. 4–6. To accomplish this, door 48 are opened by pivoting them forwardly into abutment with the inner sides 44 of their respective pedestals 30. The doors 48 may be held in this open position with magnetic catches or the like. The pedestals 30 are removed on their wheels 40 from the front portion 34 of the desk opening 32. The pedestals 30 may be positioned to the sides of the desk opening 32, where they may conveniently serve as night stands on the sides of the bed 56. Opening doors 48 and removing the pedestals 30 opens the entire width of the desk opening 32 between the side panels 14. The bed 56 may then be unfolded forwardly from out of the open front of the desk in the manner shown in FIGS. 7–12. When fully unfolded, bed 56 is positioned as shown in FIGS. 4–6, with the head of the bed being positioned just forwardly from the front of the desk.

The bed 56 comprises a frame 58 and a mattress 60, both of which fold up into the bed compartment or the back area 36. Pillows 62 may be added to the bed 56 after it is unfolded. The desk unit 10 thus serves as a headboard for the bed 56. The desk of the present invention is designed to incorporate a commercially available folding bed. While a number of different bed constructions may be used in the present invention, the commercially available bed that is described here and available from the Louis Pokorny Company, Inc., of Ronkomkoma, N.Y., works well in the present invention with a folding bed mattress from the Spring Air Mattress Company of Grand Rapids, Mich. Bed 56 is mounted in a cart or carriage 64 mounted on wheels 66, with the cart 64 forming a component of the complete bed unit. The cart 64 is attached by a pivot linkage 68 to an anchor location 70 on the side panels 14 of the desk 10, at opposite, lower rear corners of the desk compartment.

Figure 7:
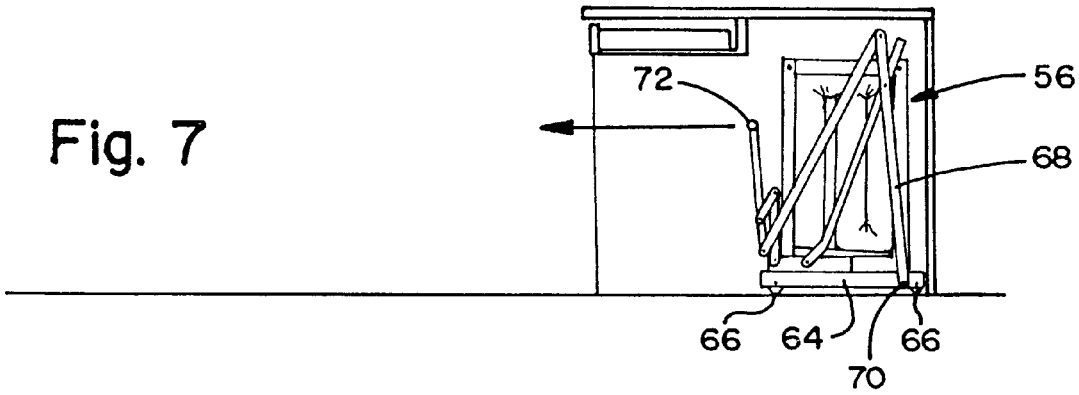
FIGS. 7–12 are the view of FIG. 3 in a sequential series that show extension of the bed from a closed position, stored under the desk, to an open position in front of the desk.
Figure 8:
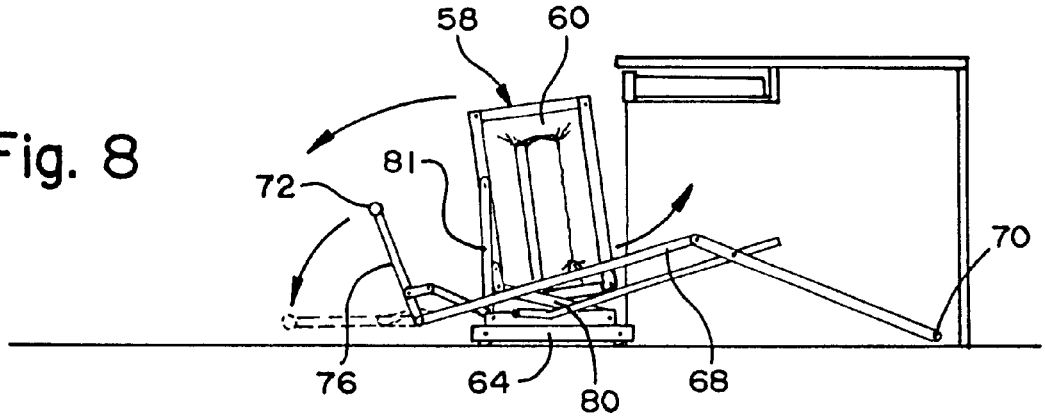

The manner in which the bed unit is withdrawn and unfolded from the desk is shown schematically in FIGS. 7–12. As shown in FIG. 7, bed 56 is withdrawn from the desk opening 32 by pulling a crossbar 72 forwardly toward the front of the desk 10. Wheeled cart 64 rolls out from the desk opening 32 until it reaches the position shown in FIG. 8, where linkage 68 becomes extended and limits further outward movement of the cart. At this point, bar 72 is pivoted downwardly and forwardly.

Figure 9:
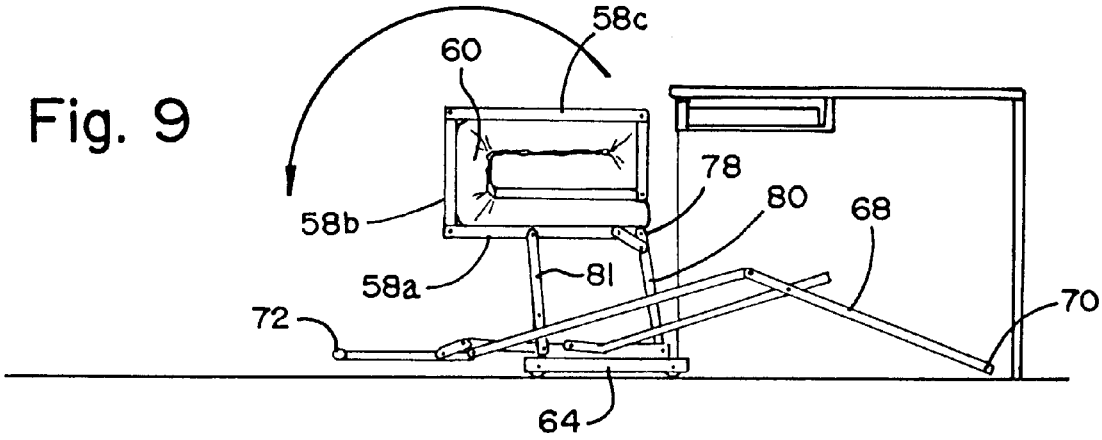

Next, the folded bed frame 58 with mattress 60 folded therein is pivoted forwardly on cart 64 in the manner shown in FIG. 9. When closed or folded up, the bed frame 58 and folded mattress 60 form a generally rectangular configuration. In the position shown in FIGS. 7 and 8, the long side of the rectangular shape is oriented vertically, so the bed 56 occupies a minimum portion of the depth in the desk opening 32. The bed frame 58 and integrally connected mattress 60 are pivoted forwardly on cart 64 in FIG. 9, thus changing the orientation of the long side of the bed frame 58 to a horizontal position. This also positions a first section **58*a* of the bed frame in a horizontal position with the mattress 60 on top of it. A rear corner 78 of bed frame section 58*a* is connected to pivoting links 80 and 81**, which pivotally interconnect the bed frame with the cart at a forward portion thereof.

Figure 10:
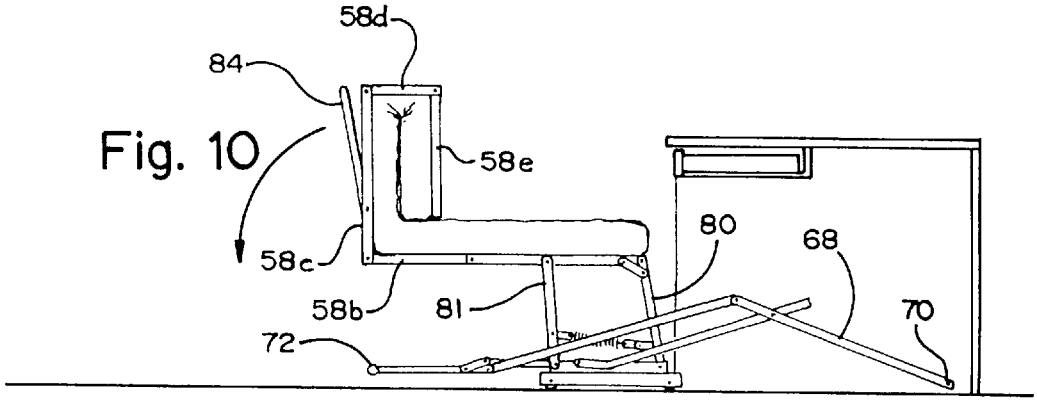

The next step in unfolding the bed 56 is to urge the bed frame forwardly and upwardly to the position shown in FIG. 10 where links 80 and 81 pivot upwardly and forwardly to an upright position, wherein they serve as legs for the front edge of the bed and support the bed at a convenient bed elevation.

Figure 11:
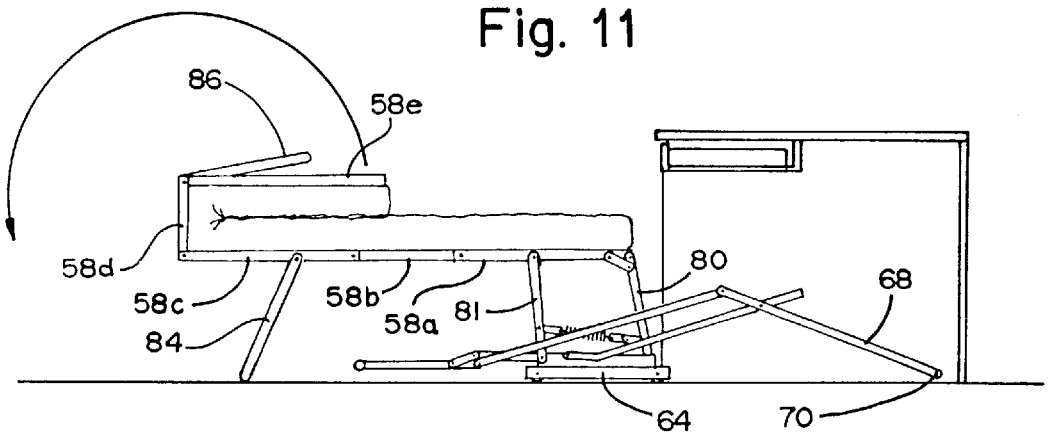

The next step in unfolding the bed 56 is to pivot bed frame members **58*b* and 58*c* outwardly to unfold the next section of bed 56, in the manner shown in FIG. 11. As sections 58*b* and 58*c* are unfolded, another leg 84 is folded downwardly so that it supports these sections 58*b* and 58*c* of the frame 58**.

Figure 12:
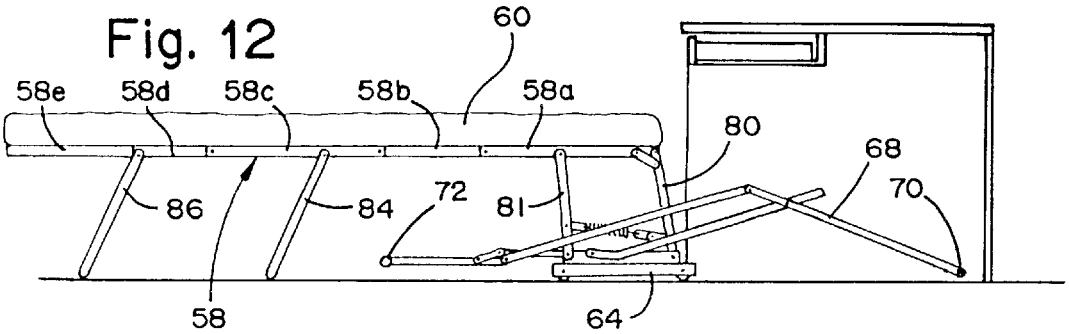

Finally, sections **58*d* and 58*e* are folded outwardly and another leg 86 is folded downwardly so the bed frame 58 and mattress 60 occupy a fully extended, generally horizontal position, as shown in FIG. 12**.

Refolding and replacing the bed 56 under the desk top 12 involves substantially the opposite procedure. When folded away, the bed 56 is fully concealed in the bed compartment or back area 36, behind pedestals 30 and doors 48.

The foregoing illustrates an exemplary embodiment of the present invention. Various changes and modifications may be made in this embodiment without departing from the spirit and scope of the present invention, which is defined in the appended claims.

We claim:

1. A combination desk and bed, comprising:

a cabinet, said cabinet having a left side panel, a corresponding opposing right side panel, a desk top supported above a floor by said left and said right side panels, a back area defined between said left and said right side panels and underneath a back portion of said desk top, and a front area defined between said left and said right side panels and underneath a front portion of said desk top;

a first pedestal, said first pedestal being removably located in said front area, near said left side panel;

a second pedestal, said second pedestal being removably located in said front area, near said right side, a kneehole being defined in said front area and between said first and said second pedestals when said first and said second pedestals are located in said front area;

a fold-up bed that is adapted to fold from an open position to a folded position and to open from said folded position to said open position, said fold-up bed being removably located in said back area when in said folded position.

2. The combination defined in claim 1 further including a moveable panel, said moveable panel extending between said first and said second pedestals to define a partition between said back area and said front area, said moveable panel being moveable between a closed position in which said moveable panel conceals said back area and an open position in which said back area and said fold-up bed are accessible.

3. The combination defined in claim 2 wherein said moveable panel includes a first door that is hinged to said first pedestal and a second door that is hinged to said second pedestal.

4. The combination defined in claim 3 wherein each of said first and said second pedestals is provided with casters to facilitate movement of said pedestal and wherein each of said first and said second pedestals has a skirt that conceals said casters.

5. The combination defined in claim 4 wherein at least one of said pedestals includes a bottom drawer that is openable to extend away from said at least one of said pedestals, and wherein a stabilizing device is connected with said bottom drawer to resist tipping and falling of said at least one of said pedestals when said bottom drawer is opened.

6. The combination defined in claim 1 wherein at least one of said pedestals includes a bottom drawer that is openable to extend away from said at least one of said pedestals, and wherein a stabilizing device is connected with said bottom drawer to resist tipping and falling of said at least one of said pedestals when said bottom drawer is opened.

7. The combination defined in claim 1 wherein said fold-up bed extends generally laterally from said first side panel to said second side panel and wherein at least one of said first pedestal and said second pedestal obstructs opening said fold-up bed from said folded position to said open position when said at least one of said first pedestal and said second pedestal is located in said front area.

8. A combination desk and bed comprising:

a cabinet, said cabinet having a first side panel, an opposing second side panel, and a top panel;

said first and said second side panels being spaced from one another and defining a desk opening therebetween, said desk opening having a front area and a back area;

a first pedestal, said first pedestal being removably located in said front area, near said first side panel;

a second pedestal, said second pedestal being removably located in said front area, near said second side panel, said first and said second pedestals defining a knee space therebetween;

a fold-up bed, said fold-up bed being adapted to fold from an open position to a folded position and being located in said back area when in the folded position, said fold-up bed also being adapted to unfold from said folded position to said open position and extending generally away from said front area, in a direction generally away from said back area, when in the open position.

9. The combination defined in claim 8 further including a moveable panel, said moveable panel extending at least partially between said first and said second side panels to define a partition between said back area and said front area, said moveable panel being moveable between a closed position in which said moveable panel conceals said back area and an open position in which said back area and said fold-up bed are accessible.

10. The combination defined in claim 9 wherein said moveable panel includes a first door that is hinged to said first pedestal and a second door that is hinged to said second pedestal.

11. The combination defined in claim 10 wherein each of said first and said second pedestals is provided with casters to facilitate movement of said pedestal and wherein each of said first and said second pedestals has a skirt that conceals said casters.

12. The combination defined in claim 11 wherein at least one of said pedestals includes a bottom drawer that is openable to extend away from said at least one of said pedestals, and wherein a stabilizing device is connected with said bottom drawer to resist tipping and falling of said at least one of said pedestals when said bottom drawer is opened.

13. The combination defined in claim 8 wherein at least one of said pedestals includes a bottom drawer that is openable to extend away from said at least one of said pedestals, and wherein a stabilizing device is connected with said bottom drawer to resist tipping and falling of said at least one of said pedestals when said bottom drawer is opened.

14. The combination defined in claim 8 wherein said fold-up bed extends generally laterally from said first side panel to said second side panel and wherein at least one of said first pedestal and said second pedestal obstructs opening said fold-up bed from said folded position to said open position when said at least one of said first pedestal and said second pedestal is in said front area.

15. A combination desk and bed comprising:

a desk top having a back edge and an opposing front edge and having a first side edge and an opposing second side edge;

a back panel positioned near said back edge, extending between said first and said second side edges, and extending generally perpendicularly downward from said desk top;

a first side panel positioned near said first side edge, extending between said back and said front edges, and extending generally perpendicularly downward from said desk top to support said desk top above a floor;

a second side panel positioned near said second side edge, extending between said back and said front edges, and extending generally perpendicularly downward from said desk top to support said desk top above the floor;

said first and said second side panels being spaced apart and defining a desk opening therebetween;

a first pedestal removably positioned in said desk opening, near said first and said front edges;

a second pedestal removably positioned in said desk opening, near said second and said front edges, a kneehole being defined between said first and said second pedestals when said first and said second pedestals are located in said desk opening; and a fold-up bed that is adapted to fold from an open position to a folded position and to open from said folded position to said open position, said fold-up bed being removably positioned in said desk opening, between said back panel and said first and said second pedestals, when said fold-up bed is folded.

16. The combination defined in claim 15 further including a moveable panel, said moveable panel extending at least partially between said first and said second side panels to define a partition between said back area and said front area, said moveable panel being moveable between a closed position in which said moveable panel conceals said back area and an open position in which said back area and said fold-up bed are accessible.

17. The combination defined in claim 16 wherein said moveable panel includes a first door that is hinged to said first pedestal and a second door that is hinged to said second pedestal.

18. The combination defined in claim 15 wherein each of said first and said second pedestals is provided with casters to facilitate movement of said pedestal and wherein each of said first and said second pedestals has a skirt that conceals said casters.

19. The combination defined in claim 15 wherein at least one of said pedestals includes a bottom drawer that is openable to extend away from said at least one of said pedestals, and wherein a stabilizing device is connected with said bottom drawer to resist tipping and falling of said at least one of said pedestals when said bottom drawer is opened.

20. The combination defined in claim 15 wherein said fold-up bed extends generally laterally from said first side panel to said second side panel and wherein at least one of said first pedestal and said second pedestal obstructs opening said fold-up bed from said folded position to said open position when said at least one of said first pedestal and said second pedestal is in said desk opening.

* * * * *